United States Patent [19]

Aronoff et al.

[11] 4,068,501

[45] Jan. 17, 1978

[54] APPARATUS FOR TREATING TUBULAR FABRICS

[75] Inventors: Edward I. Aronoff, St. Laurent; William J. McLay, Montreal, both of Canada

[73] Assignee: Knit-Fin Machinery Ltd., Montreal, Canada

[21] Appl. No.: 754,951

[22] Filed: Dec. 28, 1976

[30] Foreign Application Priority Data

Oct. 25, 1976 Canada ..... 264255

[51] Int. Cl.[2] ..... D06B 1/08

[52] U.S. Cl. ..... 68/19.1; 68/20; 68/22 R; 68/62; 68/205 R; 68/DIG. 5

[58] Field of Search ..... 68/DIG. 5, 205 R, 19.1, 68/20, 22 R, 62

[56] References Cited

U.S. PATENT DOCUMENTS

| | | | |
|---|---|---|---|
| 1,432,319 | 10/1922 | Brandwood et al. | 68/DIG. 5 |
| 1,525,423 | 2/1925 | Hernandez-Mejia | 68/62 X |
| 3,511,066 | 5/1970 | Fleissner | 68/62 X |
| 3,563,065 | 2/1971 | Fleissner | 68/DIG. 5 |
| 3,608,340 | 9/1971 | Fleissner | 68/DIG. 5 |
| 3,717,015 | 2/1973 | Spencer | 68/205 R X |
| 4,016,733 | 4/1977 | Fleissner | 68/DIG. 5 |

FOREIGN PATENT DOCUMENTS

| | | | |
|---|---|---|---|
| 20,964 | 1/1930 | Netherlands | 68/205 R |

*Primary Examiner*—Philip R. Coe

*Attorney, Agent, or Firm*—Alan Swabey & Co.

[57] ABSTRACT

A continuous washing machine has an impregnation bath and a rinsing chamber. The rinsing chamber includes three successive sieve drums over which the tubular fabric is made to pass. The fabric passes over the second downstream sieve drum in a reverse direction so as to overturn the fabric and expose the other surface thereof and to retain the fabric over the sieve drum. A sump area is maintained in the bottom of the chamber, and the liquors from the sump are recirculated by means of spray pipes spraying rinse liquor onto the fabric. The spent rinse liquor coming from the fabric over the first sieve drum is drained out of the chamber.

5 Claims, 1 Drawing Figure

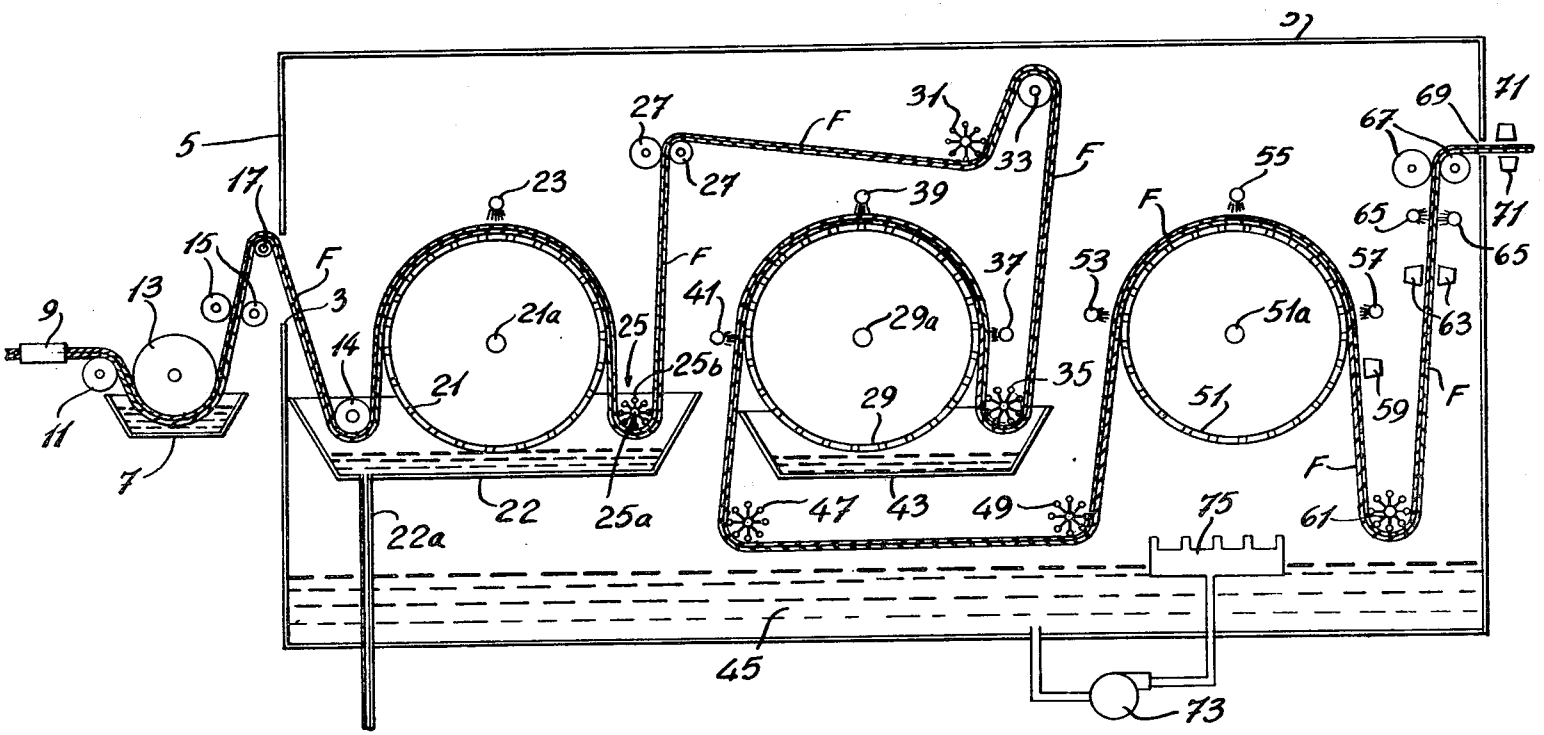
71
71
65
69
63
F
67
65
57
59
F
61
51a
55
51
75
73
F
53
35
F
33
37
49
31
39
29a
29
43
F
47
45
27
41
25b
27
F
25
25a
23
21a
22
21
22a
14
F
3
17
5
15
13
7
9
11

APPARATUS FOR TREATING TUBULAR FABRICS

BACKGROUND OF THE INVENTION

1. Field of the Invention

The present invention relates to an apparatus for treating tubular fabrics, and in particular, to apparatus for continuously wet treating a fabric, especially a knitted tubular fabric.

2. Description of the Prior Art

It has been known to merely wash a tubular fabric, as shown in U.S. Pat. No. 3,563,065, issued Feb. 16, 1971, H. Fleissner, inventor. The imporant thing in a wet treatment or washing of tubular fabrics is to properly expose both flat surfaces of the tubular fabric to the liquor treatment. According, in Fleissner, a pair of drums which are perforated are provided one above each other such that the fabric, as it worms its way around the two rollers, will expose successively both surfaces of the fabric. However, it is believed that such a system, although it may be very effective for washing the fabric, may not be proper to rinse the fabric.

SUMMARY OF THE INVENTION

Accordingly, it is an aim of the present invention to provide an efficient, high speed apparatus for washing and rinsing a tubular knitted fabric. It is a further aim of the present invention to provide apparatus for washing a tubular fabric which consumes a minimum amount of water.

In a method of using the apparatus in accordance with the present invention, a tubular fabric is first passed through a liquid treatment bath and into a rinsing chamber; the fabric is passed through a first rinsing station where it is supported along a support surface and is sprayed, reversing the fabric such that the other surface of the tubular fabric is exposed as it passes through a second rinsing station, at which time the fabric is again supported on a support surface and is being sprayed, extracting spent liquors within the fabric and withdrawing the fabric from the rinsing chamber.

An apparatus in accordance with the present invention includes a first liquid treatment impregnation bath, roller means for guiding the tubular fabric through the bath, squeeze rollers for removing excess treating liquid from the fabric, a first sieve drum, roller means for passing the tubular fabric over the sieve drum, spray means for spraying the fabric as it passes over the first sieve drum, a second sieve drum downstream of the first sieve drum, a series of roller means for passing the fabric above the second sieve drum and returning it in the opposite direction over and in contact with the second sieve drum such that the fabric has been reversed to expose the other surface thereof, spray means for spraying rinsing liquid onto the fabric as it passes over the second sieve drum, a liquid collecting tray below the second sieve drum, roller means for passing the fabric underneath the collecting tray below the second sieve drum, and means for removing the excess rinsing liquor from the fabric.

In a still more specific embodiment of the apparatus, a liquid collection sump is provided below the sieve drums for collecting rinse liquid cascading from the fabric as it is being sprayed, a collecting tray underneath the first sieve and the liquid in said collecting tray being drained as spent liquor, and means for recirculating the rinsing liquid in the sump to the spray means, at least one spray means being connected to a fresh source of rinsing liquid in an amount substantially equal to the amount of spent liquors being drained from the second collecting tray.

BRIEF DESCRIPTION OF THE DRAWINGS

Having thus generally described the nature of the invention, reference will now be made to the accompanying drawing, showing by way of illustration, a preferred embodiment thereof, and in which:

The drawing is a schematic side elevation of a typical washing apparatus in accordance with the present invention.

DESCRIPTION OF THE PREFERRED EMBODIMENTS

Referring now to the drawing, there is shown schematically a closed-in tank 5 having an inlet 3 and a sump area 45.

Immediately upstream of the inlet 3 in an impregnation station including a quetch or at least a driven stretcher frame 9 delivering the tubular frabric F into an impregnation bath 7 by means of the guide roller 11 and around the sieve drum 13. The sieve drum 13 would be constructed with a screen-like mesh to allow the liquid in the bath to penetrate the fabric from both sides thereof. The sieve drum 13 could be driven. The type of liquor used in the present embodiment would be a washing detergent, and the fabric, once it leaves the bath 7, passes between squeeze rollers 15 which remove the excess detergent liquid from the fabric F and allows it to drip back into the impregnation bath 7.

The fabric then passes over an idler guide roller 17 and through the inlet opening 3 of the tank 5, and then under an idler guide roller 19 and over a large sieve drum 21. A drainage tray 22 is provided underneath the sieve drum 21 and is connected to a drain pipe **22*a* to drain the spent liquid dripping into the tray 22, from the system. A rinsing spray pipe 23 extends parallel to the axis of the sieve drum 21 and sprays the liquid onto the fabric F as it passes over the sieve drum 21**.

The fabric F then passes underneath an idler beater roller 25 and then vertically up through the squeeze rollers 27. The beater roller includes a shaft **25*a* and a plurality of tubes or rods 25*b* equally distributed concentrically with the shaft 25*a*. As the fabric passes around the so-called beater roller 25, the polygonal surface effect of the rods causes the fabric to agitate slightly, thereby helping to reduce the build-up of air within the tubular fabric which would form an undesirable bubble which might cause distortion in the fabric. The passing of the fabric upwardly in a vertical plane through the squeeze rollers 27 also has the effect of forcing the water to cascade down the plane of the tubular fabric into the drainage tray 22. The fabric F then passes overhead in the tank 5 under a further beater roller 31 and over a guide roller 33. Below the fabric F is a sieve drum 29 mounted on a driven shaft 29*a*. The fabric is passed through the circuitous path of travel about the rollers 27, 31 and 33 as well as the beater roller 35, in order to lay the fabric F on the sieve drum 29**, exposing the other surface of the fabric. It has been found preferable to pass the fabric over the sieve drum as opposed to the simpler method of passing it under the sieve drum to expose the other face of the fabric. The fabric in this manner is being supported by the sieve drum as spray rinse watrer is impregnated in the fabric rather than underneath the drum where the added weight of the liquid would tend to pull the fabric away from the drum, causing some tension and certain distortion in the fabric.

As the fabric passes the beater roller 35 onto the sieve drum 29, a first rinse spray pipe 37 is provided as well as spaced-apart spray pipes 39 and 41. A collector tray 43 is provided under the sieve drum 29, but drains immediately into the sump area 45. The fabric, as it comes off the sieve drum 29, passes underneath a beater roller 47 and a further beater roller 49, which guides the fabric in a horizontal path directly underneath the sieve drum 29. The tray 43 is provided to prevent the water draining off the fabric F as it passes over the sieve drum 29 from cascading onto the fabric F as it passes on the horizontal plane between the beater rollers 47 and 49.

The fabric F is then pased over a third sieve drum 51 past the spray pipes 53, 55 and 57, which are provided for supplying further rinse water onto the advancing fabtic F. The sieve drum 51 is similarly mounted on a drive shaft 51*a*. As the fabric F passes over the sieve drum 51 and under the spray pipes 53, 55 and 57, it advances downstream past a first vacuum box 59 which has a slit extending across the width of the fabric to help extract some of the air building up in the fabric and to further reduce the possibility of a bubble forming, especially prior to the squeeze rolls 67. As the fabric F advances in a vertical plane from the beater roll 61 to the squeeze rolls 67, it passes between two further vacuum boxes 63 and then to a pair of parallel spray pipes 65 which will spray the fabric along its width thereof from both sides with fresh water or other rinsing liquor. The liquid will cascade down the surface of the fabric in the vertical plane and will drip into the sump area 45 of the tank 5. Finally, the fabric F passes through the pair of squeeze rolls 67 to remove most of the excess rinse liquid in the fabric, and the fabric passes out of the tank 5 through the outlet 69 between the further vacuum boxes 71 which reduces the humidity within the fabric.

All of the water being sprayed onto the fabric over the sieve drums 29 and 51 as well as with the spray pipes 65, falls into the sump area 45. The water being sprayed by means of spray pipe 23 onto the fabric in the area of the drum 21 is collected in the drain tray 22 and is taken away from the system by means of the drain pipe 22*a*. The rinsing water in the sump area 45 is recirculated to the spray pipes 37, 39, 41, 53, 55 and 57 as well as the spray pipe 23 by means of a pump 73 through a mainfold 75. Communicating conduits (not shown) extend from the manifold 75 to the various drain pipes mentioned. The amount of water being fed to the spray pipe 65 from outside system equals approximately the amount of spent rinse water being drained from the drain tray 22.

We claim:

1. An apparatus for treating tubular fabric, including a liquid treatment impregnation bath, means for passing the fabric through said bath, squeeze rollers for removing excess treating liquid from the fabric as it exits from the treatment bath, a first sieve drum, roller means for passing the tubular fabric over the first sieve drum, spray means for spraying rinse liquid onto the fabric as it passes over the first sieve drum, a second sieve drum downstream of the first sieve drum, means for passing the fabric above the second sieve drum and returning it in the opposite direction over and in contact with the second sieve drum such that the fabric has been reversed to expose the other surface thereof, spray means for spraying rinsing liquid onto the fabric as it passes over the second sieve drum, means for passing the fabric underneath the second sieve drum, and means for removing the excess rinsing liquor from the fabric.

2. An apparatus as defined in claim 1 wherein a first collecting tray is provided below the second sieve drum, a liquid collecting sump is provided below the sieve drums for collecting rinse liquid cascading from the fabric and from the first collecting tray, the liquid in the first tray draining into the sump and the fabric being made to pass underneath the first tray, a second collecting tray underneath the first drum, the liquid in said second collecting tray being drained as spent liquor, and means for recirculating the rinsing liquid from the sump to the spray means, at least one spray means being connected to a fresh source of rinsing liquid and adapted to spray an amount substantially equal to the amount of spent liquor being drained from the second collecting tray.

3. An apparatus as defined in claim 2, wherein a third sieve drum is provided downstream of the second sieve, a closed housing is located about the sieve drums and the sump, and after the fabric is moved below the collecting tray underneath the second sieve drum, it is passed over the third sieve drum, spray means are provided for spraying rinsing liquid over the fabric as it passes over the third sieve drum, first vacuum suction means are provided adjacent the path of the fabric as it exits from the third sieve drum, means are provided downsteam of said first vacuum suction means for passing the fabric in a vertical plane upwards in a downstream direction, squeeze rollers are provided in the upper reaches of the vertical plane for squeezing excess liquid from the fabric, and further vacuum means are provided adjacent the vertical plane of the fabric for removing excess air and liquid from the fabric.

4. An apparatus as defined in claim 1, wherein a third sieve drum is provided downstream of the second sieve drum, the three sieve drums being arranged in series and located in a closed-in chamber, means are provided for passing the fabric over the third sieve drum, and spray means are provided for spraying further rinsing liquid on the fabric as it passes over the third sieve drum.

5. An apparatus as defined in claim 1, wherein the means for passing the fabric includes idler rollers and certain of the rollers include an idler shaft and a plurality of rods concentric with the shaft forming a polygonal outline whereby, as the fabric is passed over the rollers, a slight agitation is sustained by the fabric such as to reduce the build-up of air within the fabric.

* * * * *

Disclaimer 4,068,501.—*Edward I. Aronoff*, St. Laurent; *William J. McLay*, Montreal, both of Canada. APPARATUS FOR TREATING TUBULAR FABRICS. Patent dated Jan. 17, 1978. Disclaimer filed Jan. 24, 1990, by the assignee, Knit-Fin Machinery, Ltd.

The term of this patent subsequent to Dec. 31, 1989, has been disclaimed.

[ *Official Gazette April 17, 1990* ]